US005328547A

United States Patent [19]

Boldrini et al.

[11] Patent Number: 5,328,547

[45] Date of Patent: Jul. 12, 1994

[54] DEVICE FOR SEPARATING THE LEADING END OF A NEW STRIP FROM THE TRAILING END OF A DEPLETED STRIP DURING RENEWAL OF THE SUPPLY OF STRIP MATERIAL TO A MANUFACTURING MACHINE

[75] Inventors: Fulvio Boldrini, Ferrara; Antonio Gamberini, Bologna, both of Italy

[73] Assignee: G.D. S.p.A., Bologna, Italy

[21] Appl. No.: 43,836

[22] Filed: Apr. 7, 1993

[30] Foreign Application Priority Data

Apr. 7, 1992 [IT] Italy ..... BO92 A 000121

[51] Int. Cl.[5] ..... B32B 35/00

[52] U.S. Cl. ..... 156/584; 156/344; 270/52.5; 226/5

[58] Field of Search ..... 156/344, 584, 267, 247, 156/159, 361; 271/280, 281, 285, 900; 270/52.5; 226/4, 5, 28; 242/58.4, 57; 83/130, 163, 166

[56] References Cited

U.S. PATENT DOCUMENTS

| | | | |
|---|---|---|---|
| 2,714,241 | 8/1955 | Simler et al. | 29/17 |
| 3,614,095 | 10/1971 | Beck et al. | 271/280 |
| 3,677,538 | 7/1972 | Wall | 271/900 X |
| 3,975,559 | 8/1976 | Paulson et al. | 156/247 X |
| 3,984,097 | 10/1976 | Touchette | 271/280 |
| 4,447,052 | 5/1984 | Müller | 271/280 |
| 4,595,931 | 6/1986 | Toganoh et al. | 156/247 X |
| 4,893,146 | 1/1990 | Tachibana et al. | 271/900 X |
| 5,091,042 | 2/1992 | Bruckner | 156/584 |
| 5,101,701 | 4/1992 | Boldrini et al. | 83/13 |
| 5,249,754 | 10/1993 | Liermann et al. | 242/57 X |

FOREIGN PATENT DOCUMENTS

| | | |
|---|---|---|
| 903426A | 4/1990 | Italy . |
| 2242676 | 10/1991 | United Kingdom . |

*Primary Examiner*—David A. Simmons
*Assistant Examiner*—Mark A. Osele
*Attorney, Agent, or Firm*—Cushman, Darby & Cushman

[57] ABSTRACT

In a packaging machine supplied continuously with strip material fed forward by means of pinch rolls and trimmed at a cutting station, the leading end of a new strip is overlapped with the trailing end of the depleted strip at the moment of effecting a changeover; the two strips are separated, before entering the cut, by a device comprising a pair of feelers stationed between the pinch rolls and the cutting station, and capable of movement at least between an at-rest position in which the feelers remain outside the dimensional compass of the strip material, and an operating position in which the feelers are moved substantially into alignment with the leading end of the new strip in such a way as to slip beneath and detach it from the trailing end of the depleted strip.

5 Claims, 2 Drawing Sheets

8
16
10
G
11
17
15
6
13a
7
13
F
4
5
2
12
9
16
20
18
10
6
15
14
19
13a
13

DEVICE FOR SEPARATING THE LEADING END OF A NEW STRIP FROM THE TRAILING END OF A DEPLETED STRIP DURING RENEWAL OF THE SUPPLY OF STRIP MATERIAL TO A MANUFACTURING MACHINE

BACKGROUND of the INVENTION

The present invention relates to a device serving to separate the leading end of a new strip from the trailing end of a depleted strip when renewing the supply of a strip material used by a manufacturing machine.

In particular, the invention relates to a separator device for use in association with changer devices designed to handle relatively rigid strip material, typically paper materials of a certain thickness such as cardboard. To ensure a ready comprehension, reference is made by way of example to devices for changing rolls of cardboard strip as used typically in fashioning the internal reinforcing elements, or frames, fitted to cigarette packets with a hinged lid.

The prior art embraces changer devices such as that disclosed in application no. 3426A/90 for Italian Patent, illustrated here in its entirety to the end of ensuring a comprehensive description; devices of the type comprise an arcuate guide of "U" section along which to direct the strip in use, feed rolls which advance the strip by traction, means by which to distance the trailing end of each depleted strip from the device, and a cutting mechanism by which the strip is severed in the transverse direction. When the moment arrives for the roll to be changed, a second strip from a new roll is directed along the guide, pushed from the rear. Due to the rigid embodiment of the depleted and new strips, and the action of a diverter roller afforded by the concave face of the "U" section guide, the trailing end of the depleted strip and the leading end of the new strip are caused to overlap, disposed with the end of the new strip nearer to the diverter roller than that of the depleted strip. Before the overlapping ends of the new and depleted strips can reach the cutting mechanism together, the trailing end of the depleted strip is taken up by the distancing means and directed away toward a waste drop.

Users of these devices have encountered problems of a practical nature, however, attributable to the mutual adhesion between the two overlapping strips. The effect of the adhesion is such that, at the moment when the trailing end of the depleted strip is taken up by the distancing means, the leading end of the new strip is also diverted toward the waste drop, and manual intervention is required to restore normal operating conditions.

In the case outlined by way of example, certain of the feed rolls serve also to effect longitudinal cuts by which the strips are scored or pierced. These cuts are necessary to the formation of the finished packet, but being made simultaneously in both the new and the depleted strip, their effect is to increase the mutual adhesion in question; as a result, the operation of distancing the trailing end of the depleted strip in isolation is rendered still more difficult, and the changer device can become jammed. The take-up means must be positioned immediately preceding the cutting mechanism in any event, given the need to avoid excessive amounts of waste and reject material.

The object of the present invention is to preclude the risk of mutual adhesion between the two strips resulting in a jam at the changer device.

SUMMARY of the INVENTION

The stated object is realized, according to the present invention, in a device for separating the leading end of a new strip from the trailing end of a depleted strip during the renewal of a supply of strip material to a manufacturing machine, designed to operate in association with a changer device comprising feed means, means by which to cut the strip material and means by which the trailing end of the depleted strip is taken up and distanced, before reaching the cutting means, from a position in which the leading end of the new strip and the trailing end of the depleted strip are overlapped. The device disclosed comprises detachment means, stationed and operating between the feed means and the cutting means and capable of movement between an at-rest position, outside the compass of the trajectory described by the strip material, and an operating position, inserted between the leading end of the new strip and the trailing end of the depleted strip, with the strips in motion, in such a way as to separate the two ends from one another.

BRIEF DESCRIPTION OF THE DRAWINGS

The invention will now be described in detail, by way of example, with the aid of the accompanying drawings, in which.

DESCRIPTION of the PREFERRED EMBODIMENTS

Figure 1:
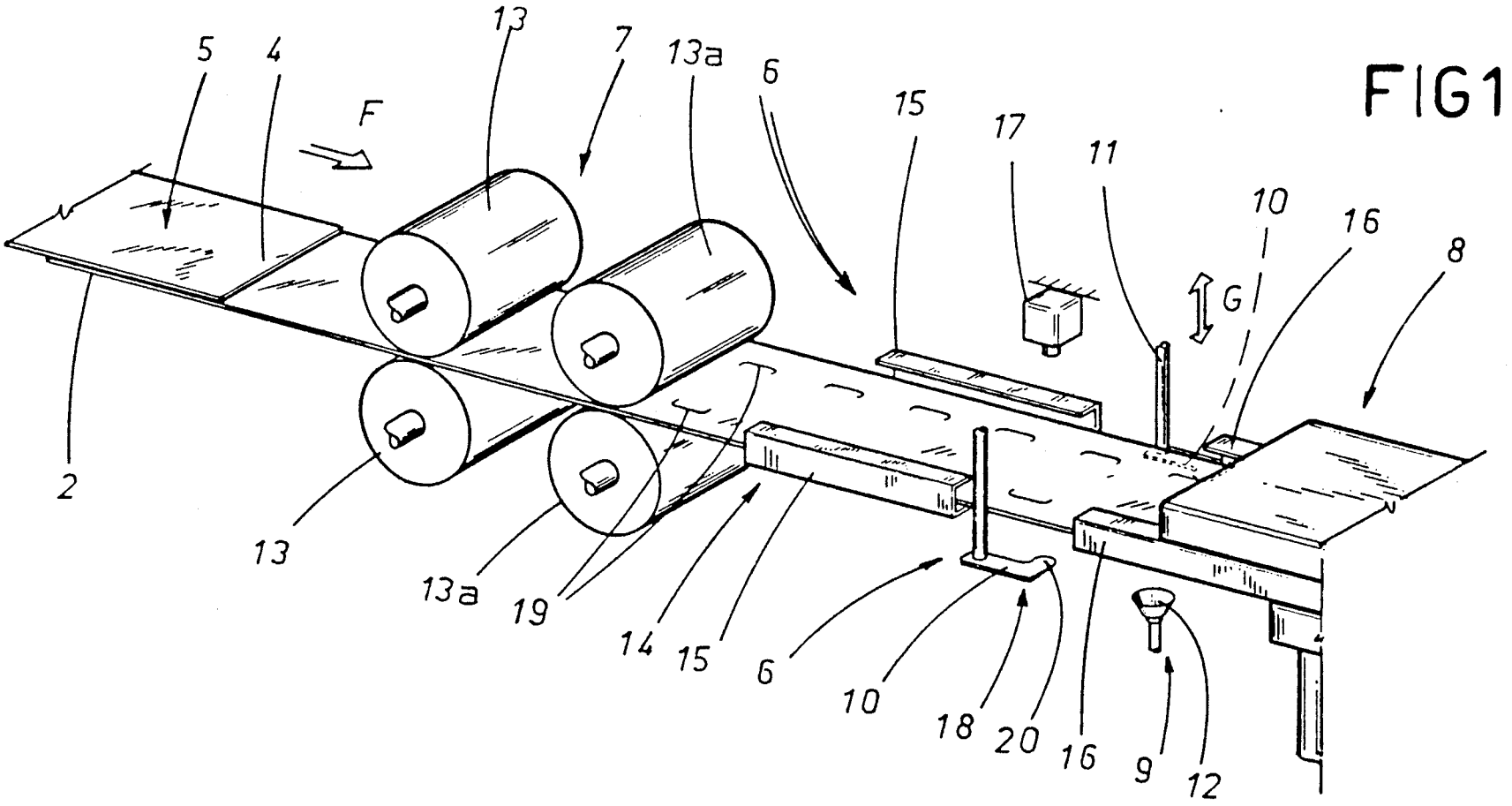
FIG. 1 is the schematic representation of a device for changing strip material automatically, viewed in perspective, equipped with the separator device according to the invention shown in its at-rest configuration.

In FIG. 1 of the drawings, 1 denotes the separator device according to the invention, in its entirety, which is shown associated with an automatic changer device 6 serving to ensure a continuous supply of relatively rigid strip material 3 and 5, typically paper or cardboard, to a manufacturing machine (not illustrated).

The parts of the changer device 6 shown in FIG. 1 include feed means 7 by which the strip material 3 and 5 is directed forward, means 8 by which to cut the strip in the transverse direction, and means 9 by which the trailing end 2 of the depleted strip 3 is taken up and distanced from the new strip.

Figure 2:
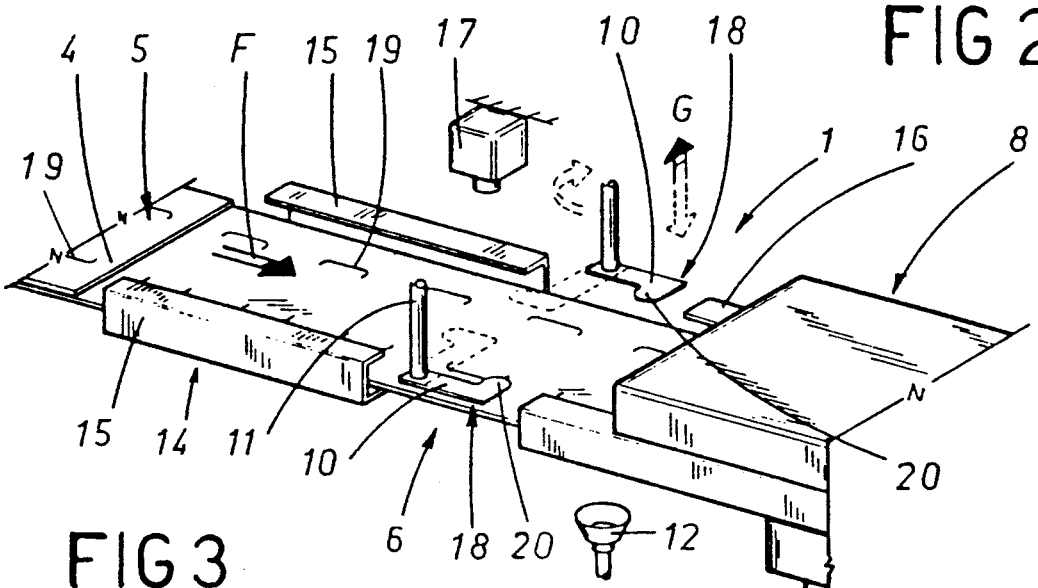
FIGS. 2 and 3 are further perpective views of the separator device of FIG. 1.
Figure 3:
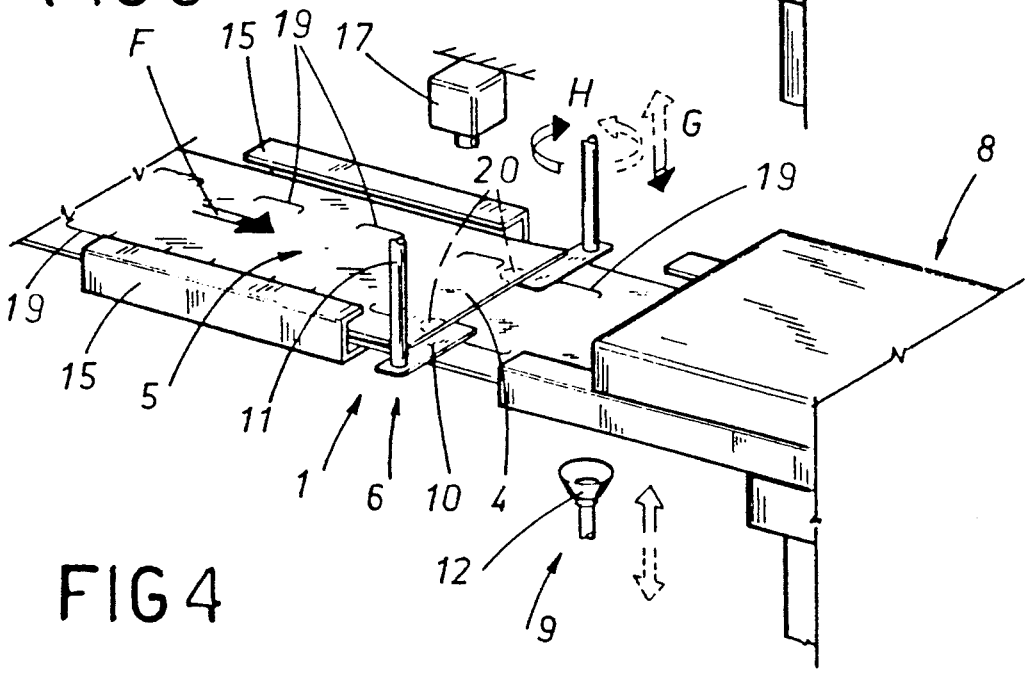

The take-up means 9, illustrated in the drawings as a suction cup 12 connected to a source of negative pressure (not shown), are stationed and caused to operate between the feed means 7, which appear as a first pair and a second pair of pinch rolls 13 and 13*a* (at least one of which power driven), and the cutting means 8, which occupy a position beyond the rolls 13 in relation to the direction F followed by the strip material 3 and 5. One of the two pairs of rolls 13 or 13*a* can be used to pierce a succession of longitudinal cuts 19 in the strip material 3 and 5 as illustrated in FIGS. 1 to 3; in the example of FIG. 1, the piercing rolls are those denoted 13*a*. 14 denotes a horizontal guide occupying a position between the rolls 13–13*a* and the cutting means 8, fashioned from four discrete members 15 and 16 of "C"

section, for example, as shown in the drawings, which are arranged in mutually opposed pairs and set apart one from another in such a manner as to establish a virtual table for the support of the strip material 3 and 5.

17 denotes a sensor positioned immediately beyond the rolls 13*a* in the feed direction F and above the first guide members 15, of which the function is to detect the passage of the leading end 4 of a new strip 5 and thereupon relay a corresponding signal to a control unit (not illustrated).

The suction cup 12 of the take-up means occupies a position preceding the cutting means 8, below the second guide members 16, and is capable of movement upward to the point of entering into contact with the strip material 3 or 5 at a point between the guide members 16.

The separator device 1 according to the invention is stationed between the first members 15 and the second members 16 of the guide, hence between the feed means 7 and the cutting means 8.

The device 1 comprises detachment means 18 disposed and operating between the pairs of rolls 13–13*a* on the one hand and the cutting means 8 on the other, which are capable of movement between an at-rest position, outside the compass of the trajectory described by the moving strip material 3 and 5, and an operating position inserted between the leading end 4 of a new strip 5 and the trailing end 2 of the depleted strip 3, still in motion, in such a way as to separate the one from the other.

Figure 4:
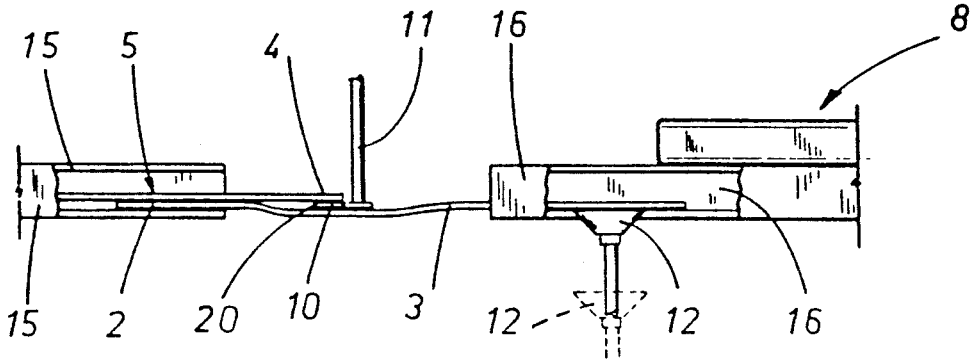
FIG. 4 illustrates the separator device of FIG. 3 in a side elevation, with certain parts omitted.

The detachment means 18 consist in at least one flat slender feeler 10 capable of movement between an at-rest position, and an operating position of substantial alignment with the leading end 4 of the new strip 5, and ultimately of insertion beneath this same strip (FIGS. 3 and 4).

In moving to the operating position, the feeler 10 proceeds to the point of entering into contact with the trailing end 2 of the depleted strip 3 (see FIGS. 2 and 3) and distancing it forcibly from the leading end 4 of the new strip 5 (see FIG. 4).

FIGS. 1 to 3 illustrate two feelers 10 stationed on opposite sides of the strip material 3 and 5, each carried by a relative arm 11 capable of vertical movement (indicated by the arrow denoted G in FIGS. 1 to 3) between two limit positions in which the feeler 10 is disposed respectively above and below the guide 14. The two arms 11 are also rotatable, each about a vertical axis (see arrow denoted H in FIGS. 2 and 3), through the agency of drive means (not illustrated) piloted by the aforementioned control unit, in such a way as to move the relative feeler 10 between a position substantially parallel with the longitudinal axis of the strips 3 and 5 and a position substantially perpendicular to the same axis (see FIG. 2).

At the moment of changing the rolls, with the new strip 5 and the depleted strip 3 proceeding forward together, the leading end 4 of the former advances to the point of overlapping with the trailing end 2 of the latter, as illustrated in FIG. 1. Up to this point, the feelers 10 remain positioned parallel with and below the level of the guide 14 while the suction cup 12 is positioned close to the depleted strip 3, between the second guide members 16.

Once the sensor 17 has detected the passage of the leading end 4, the two arms 11 are set in motion to raise the feelers 10 (see FIGS. 1 and 2) and rotate them inwards (FIGS. 2 and 3), then lowered such that the feelers 10 are brought into contact with the trailing end 2 of the depleted strip (see FIG. 3). The leading end 4 of the new strip now encounters the two feelers 10, and by virtue of their slender profile is diverted away from the trailing end 2 of the depleted strip. To ensure that the trailing and leading ends 2 and 4 do effectively separate, the feelers 10 are lowered further through a distance sufficient to flex the lower strip 3 and insert themselves between the two ends 2 and 4, as shown in FIG. 4. It will be discernible from the drawings that the feelers 10 are angled or tapered toward the oncoming strip 5 in such a way as to favor an initial separation, and embodied with respective appendages 20 to ensure their ultimate insertion between the trailing and leading ends 2 and 4 of the two relative strips 3 and 5. Once the trailing end 2 of the depleted strip has been distanced from the guide 14 by the suction cup 12, the feelers 10 descend further and rotate outwards to regain the at-rest position of FIG. 1.

What is claimed:

1. A device for separating the leading end of a new strip from the trailing end of a depleted strip during the renewal of a supply of strip material to a manufacturing machine, designed to operate in association with a changer device comprising feed means, means by which to cut the strip material and means by which the trailing end of the depleted strip is taken up and distanced, before reaching the cutting means, from a position in which the leading end of the new strip and the trailing end of the depleted strip are overlapped, wherein the separation is accomplished through the agency of detachment means stationed and operating between the feed means and the cutting means of the changer device and capable of movement between an at-rest position, outside the compass of the trajectory described by the strip material, and an operating position of insertion between the leading end of the new strip and the trailing end of the depleted strip, with the strips in motion, in such a way as to distance the two ends one from the other.

2. A separator device as in claim 1, wherein the detachment means consist in at least one flat slender feeler stationed between the feed means and the cutting means and capable of movement at least between an at-rest position, and an operating position of substantial alignment with the leading end of the new strip in which the selfsame leading end is intercepted without its progress being halted and separated from the trailing end of the depleted strip.

3. A separator device as in claim 2, wherein the scope of the movement between the at-rest and operating positions is such as to allow the trailing end of the depleted strip to be engaged forcibly by the feeler and thus flexed and distanced from the leading end of the new strip.

4. A separator device as in claim 3, wherein the feeler is capable of movement between two limit positions respectively addressing the two opposite faces of the strip material, also between an at-rest position, disposed substantially parallel to the longitudinal axis of the strip material, and an operating position disposed substantially normal to the selfsame longitudinal axis and insertable between the leading end of the new strip and the trailing end of the depleted strip.

5. A separator device as in claim 4, wherein the strip material is disposed substantially horizontal when advancing between the feed means and the cutting means, and the feeler is capable of movement in the vertical dimension between two limit positions respectively above and below the level of the strip material, and rotatable about a vertical axis between the at-rest and operating positions.

* * * * *